US006367895B1

(12) United States Patent
Huffman et al.

(10) Patent No.: US 6,367,895 B1
(45) Date of Patent: Apr. 9, 2002

(54) ENHANCEMENT TO ACCOMMODATE TALL BEVERAGE CONTAINERS IN AN AUTOMATIC MERCHANDISER

(75) Inventors: John P. Huffman, Fenton; David W. Duncan, Chesterfield; Ronald P. Petersen, Arnold, all of MO (US)

(73) Assignee: Crane Co., Stamford, CT (US)

( * ) Notice: Subject to any disclaimer, the term of this patent is extended or adjusted under 35 U.S.C. 154(b) by 0 days.

(21) Appl. No.: 09/643,400

(22) Filed: Aug. 22, 2000

(51) Int. Cl.[7] ..... A47F 3/02
(52) U.S. Cl. ..... 312/97.1; 312/97.1
(58) Field of Search ..... 312/97.1, 125, 312/135, 305, 138.1, 116, 35, 36, 72, 73; 221/12, 120, 121, 122, 155, 242

(56) References Cited

U.S. PATENT DOCUMENTS 2,482,245 A * 9/1949 Childers ..... 312/36 X
2,811,403 A * 10/1957 Barker et al. ..... 312/97.1
3,500,649 A * 3/1970 Feldman ..... 312/36 X
4,317,604 A * 3/1982 Krakauer ..... 312/97.1
4,927,051 A * 5/1990 Falk et al. ..... 221/120 X
5,169,027 A 12/1992 Falk et al.
5,244,266 A * 9/1993 Maldanis ..... 312/36 X

* cited by examiner

*Primary Examiner*—James O. Hansen
(74) *Attorney, Agent, or Firm*—Hughes & Luce, L.L.P.

(57) ABSTRACT

A multiple product merchandising machine of the rotating drum type which is capable of vending large size bottles. It includes a cylindrical merchandise carrying drum mounted within the cabinet for rotation about its central longitudinal axis disposed vertically within the cabinet and having a plurality of annular product supporting shelves at spaced intervals along the drum, concentric with the axis of the drum, a plurality vertical walls extending between adjacent shelves and together with the shelves defining a plurality of individual product compartments, a central column extending the height of the drum and having wall portions adjacent each product compartment with at least one hole defined in at least some of the wall portions, the holes so positioned and arranged that a necked-down portion of a bottle supporting a cap can be inserted into each hole with the remainder of the bottle being disposed within the confines of an associated product compartment.

6 Claims, 5 Drawing Sheets

ENHANCEMENT TO ACCOMMODATE TALL BEVERAGE CONTAINERS IN AN AUTOMATIC MERCHANDISER

BACKGROUND OF THE INVENTION

The present invention relates to multiple-product merchandising machines and more particularly to such machines which dispense many different kinds and sizes of products from a cylindrical drum mounted within a cabinet and configured to dispense the desired product to a customer upon the insertion in the machine of adequate currency or the establishment of adequate credit. Such a machine is disclosed, for example, in U.S. Pat. No. 4,927,051, owned by the same assignee as the present invention.

Some existing multiple-product merchandising machines of the type to which the present invention relates are generally configured to show to a potential customer as much of the available product as possible without rotation of the drum. This is accomplished in some cases by utilizing transparent shelves and/or walls to separate the shelves into compartments which hold individual products so that only a single product is accessible to a customer at one time. The products are accessible through access doors which are generally locked until adequate currency is inserted to allow the customer to open a door and access only the compartment adjacent it. Generally, the access doors are transparent to allow viewing of the product on the shelves and also an additional viewing area is sometimes provided to enlarge the total number of products that can be seen at one time.

Recently it has become desirable to vend, from all types of vending machines, larger bottles, such as 16 and 20 ounce bottles, because of consumer demand for larger quantities of soda and water in a single bottle. Because of the physical size limitations on drum type vending machines, both internally and externally, it is difficult to increase the size of the pie-shaped compartments in these types of vending machines such that would permit them to hold the, usually longer, larger volume bottles which do not fit into many of the existing drum-type vending machines. The diameter of the drum cannot be increased significantly because it would require a larger size cabinet which is not practical for moving through doorways or desirable in the additional floor space it would occupy. Furthermore, the substantial cost involved in the redesign and tooling in such a solution would be prohibitive. Most such drum-type machines have a hollow center column through which cooling air is distributed. This column diameter could theoretically be reduced and the compartment size correspondingly increased to possibly accommodate the larger bottles, but this would also be a substantial redesign of the shelves and other components making this solution likewise cost prohibitive.

SUMMARY OF THE INVENTION

The present invention overcomes the above-described difficulties and disadvantages associated with prior art devices by providing a modification to current designs of drum-type vending machines that will accommodate larger bottles with relatively minor changes and little additional cost.

This is accomplished by the provision of a multiple-product merchandising machine of the drum-type which has a plurality of annular shelves arranged around and fixed to a center column for rotation therewith and which shelves are divided into a plurality of compartments by radially extending walls, the center column having walls extending between the shelves in which holes are provided which allow the necked-down portion and cap of a bottle to pass through the center column wall into the interior of the column while the main body of the bottle is contained within a compartment.

Advantages of the present invention are further accomplished by the provision of a multiple-product merchandising machines comprising: a cabinet; a cylindrical merchandise carrying drum mounted within the cabinet for rotation about its central longitudinal axis disposed vertically within the cabinet and having a plurality of annular product supporting shelves at spaced intervals along the drum, concentric with the axis of the drum, a plurality vertical walls extending between adjacent shelves and together with the shelves defining a plurality of individual product compartments, a central column extending the height of the drum and having wall portions adjacent each product compartment with at least one hole defined in at least some of the wall portions, the holes so positioned and arranged that a necked-down portion of a bottle supporting a cap can be inserted into each hole with the remainder of the bottle being disposed within the confines of an associated product compartment; a plurality of access doors in the cabinet for allowing access to the shelves for removal of merchandise therefrom; and a vend control system associated with the access doors for allowing the doors to be opened upon a customer establishing a proper amount of credit in the vend control system.

Further advantages of the present invention are obtained by such a machine wherein the at least one hole is vertically positioned within an associated compartment such that the neck of a bottle inserted in the hole engages a lower portion of the hole and rests on the wall and on a bottom edge of the bottle such that the bottle is disposed at an angle sloped downwardly toward an outer edge of the compartment.

Yet further advantages are obtained by such a machine wherein the hole is so positioned and arranged that the cap of a bottle disposed in the at least one hole engages a rear side of a wall portion so as to prevent outward movement of the bottle until it is lifted by a customer to be removed from the compartment.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
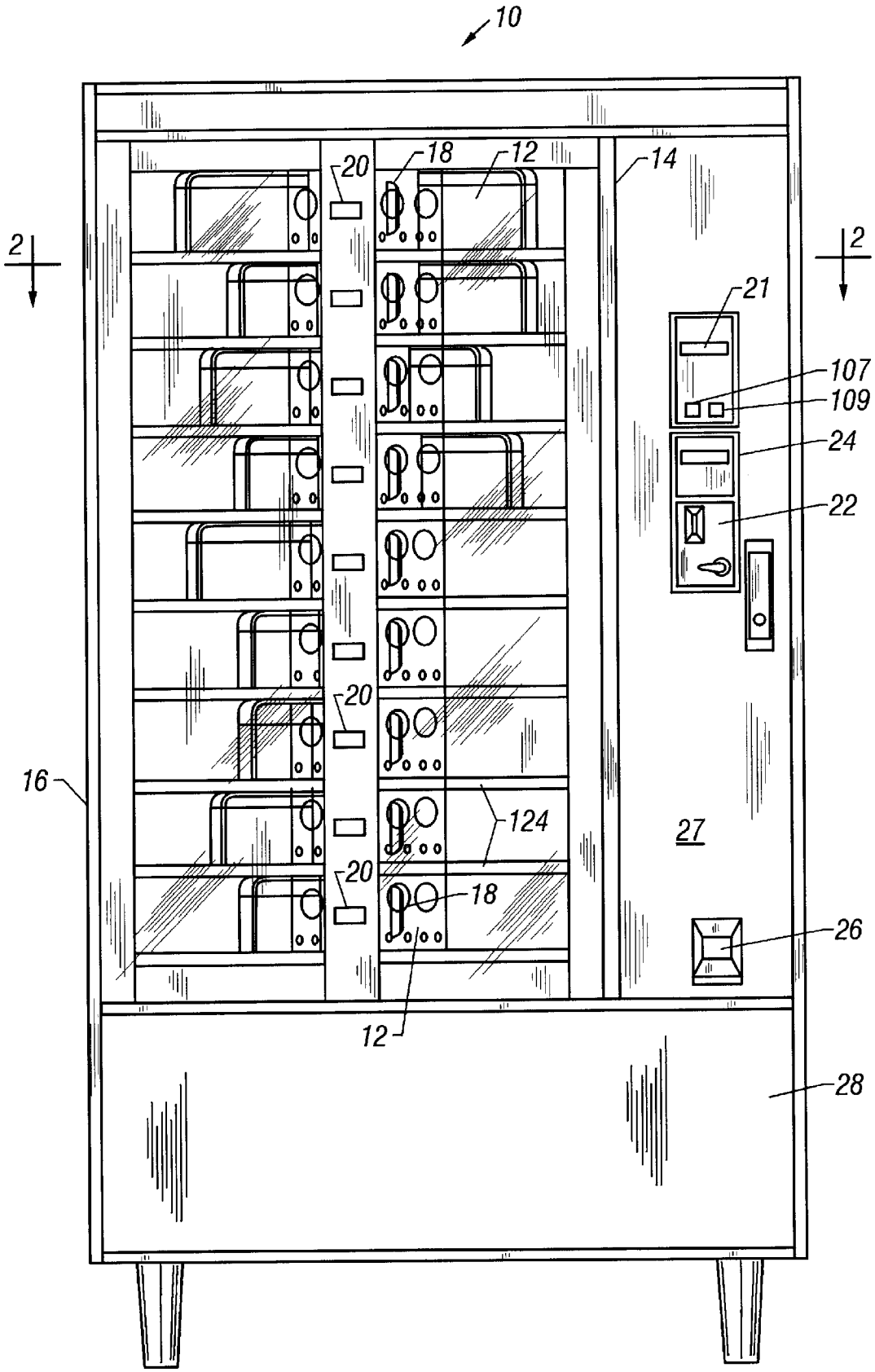
FIG. 1 is a front view of the preferred embodiment of the multiple-product merchandising machine of the present invention.

In the preferred embodiment of the multiple-product merchandising machine 10 of the present invention, as best seen in FIG. 1, a plurality of transparent access doors 12 are mounted in the front service door 14 which forms most of the front of the Cabinet 16 of the machine. The access doors 12 are in a common vertical plane and are slidably mounted within the service door 14 for horizontal sliding movement between a closed, normally locked position, as they are shown in FIG. 1, and an open position which permits access to the interior of the cabinet 16. A handle 18, also transparent, is mounted to or formed in each access door 12 to permit the doors to be manually moved between the open and closed positions. Adjacent each door 12 is a price display 20 which indicates the price of the product which can be purchased and removed from the adjacent door. The price displays are electronic, such as LED, LCD or similar electronic form. A similar electronic display 21 for credit and other messages is mounted on the service door 14.

Figure 2:
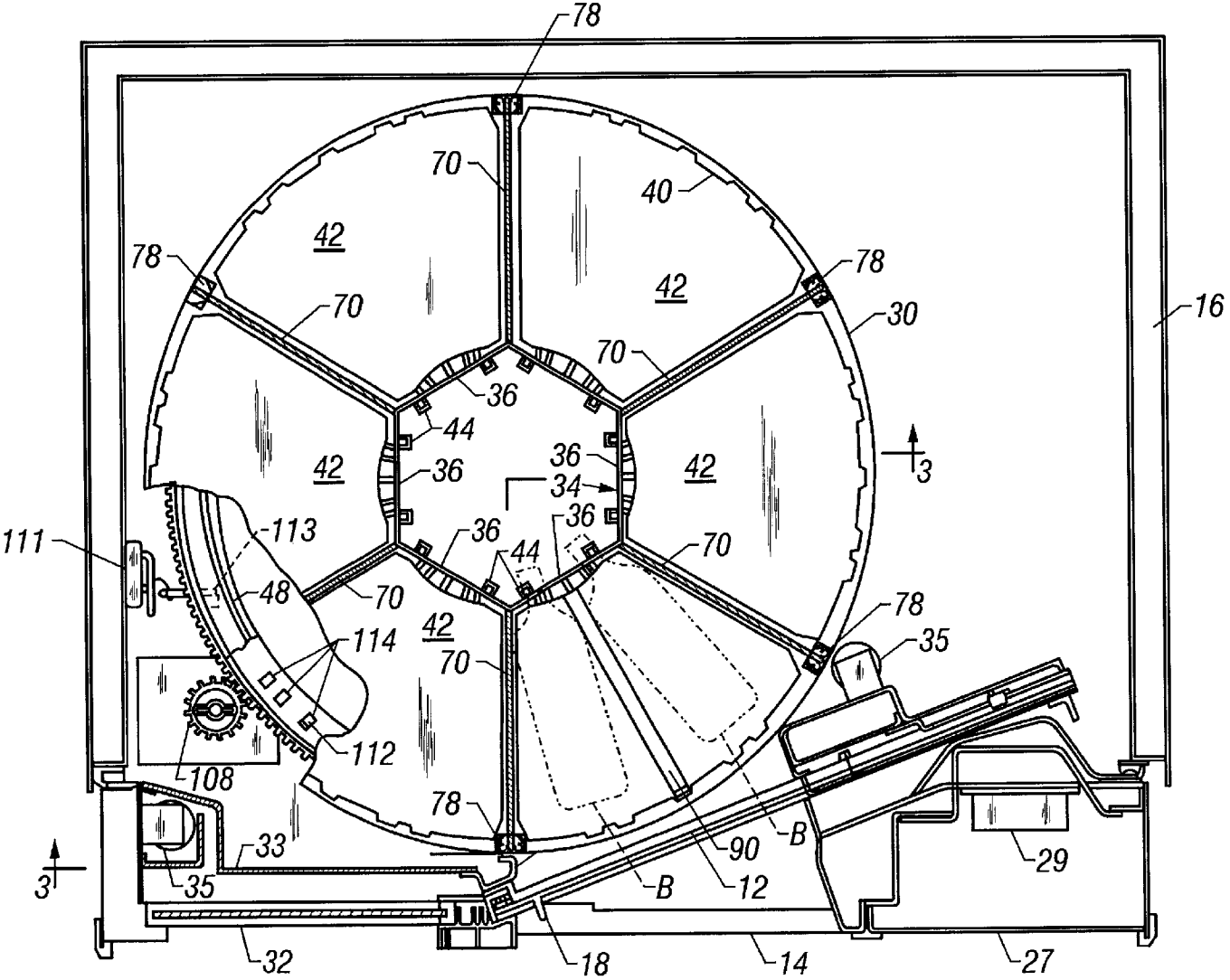
FIG. 2 is a cross sectional view along the line 2—2 of FIG. 1.

Also mounted in the service door 14 are coin and bill receiving and validating mechanisms 22 and 24, respectively, and a coin return receptacle 26, all of a form well known in the industry. The service door 14 is hinged on the left of the cabinet 16 as viewed in FIG. 2. A monetary door 27 is mounted within and forms part of the service door 14 and is also hinged on its left edge. The monetary door 27 covers the coin mechanism 22 and bill validator 24 which are contained within the space in the service door behind the monetary door 27 as seen in FIG. 2. Also contained in this area behind the monetary door is the microprocessor based control panel 29 used to set various functions of the machine including prices and discounts in a well known manner. A front skirt 28 forms the lower part of the service door 14 and covers an area of the cabinet beneath the access doors 12 which houses refrigeration equipment, etc.

As best seen in FIG. 2, mounted within the cabinet 16 for rotation is a cylindrical merchandise carrying drum 30 disposed behind the access doors 12 and a glass plate 32 forming an additional product viewing area behind which is a transparent plastic air deflection and insulation sheet 33. Fluorescent lights 35 are disposed on the service door 14 on each side of the viewing area to assist a customer in viewing the products.

Figure 3:
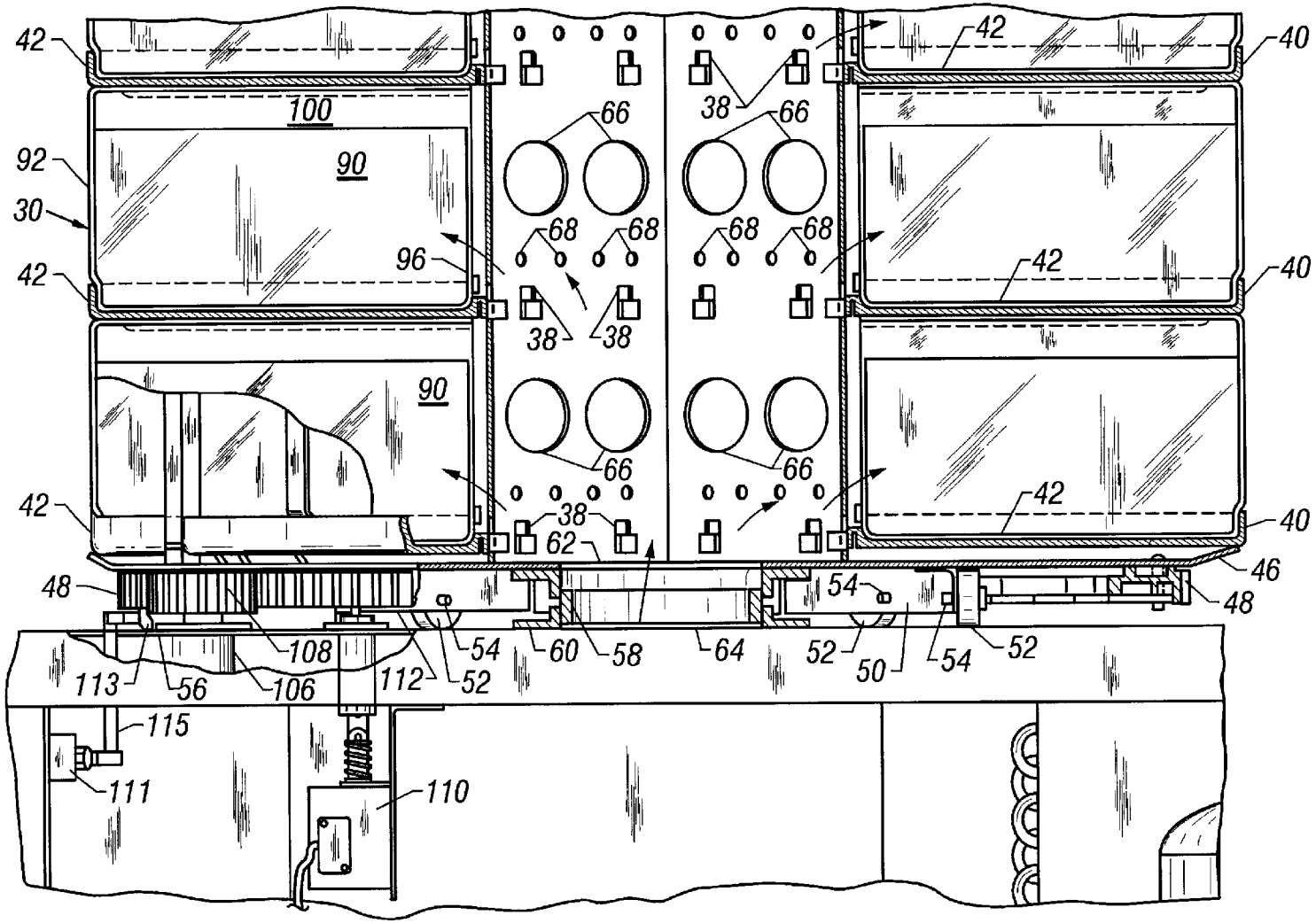
FIG. 3 is an enlarged partial cross sectional view along the line 3—3 of FIG. 2.

The drum 30 is composed of a hexagonal sheet metal center column 34 which extends the full height of the drum. Each panel 36 which forms a side of the center column 34 has two rectangular holes 38 (FIG. 3) formed therein at the level of each of the annular shelves 40. Each shelf 40 is composed of six identical transparent plastic trays 42, each of which has tabs 44 which are received in the respective holes 38 and rest on the lower edge thereof to position the trays around the column 34. Bolted or otherwise secured to the top of the column is a sheet metal top disk (not shown) with a diameter approximately the same as the diameter of the annular shelves 40.

The bottom of the column 34 is fastened to a sheet metal base disk 46, approximately the diameter of the annular shelves 40, which in turn has bolted thereto a plastic ring gear 48 with a diameter also approximately the diameter of the shelves 40. A sheet metal ring 50 with an L-shaped cross section is fastened to the bottom of disk 46 and has a diameter less than the diameter of the ring gear 48. The ring 50 supports a plurality of rollers 52 on pins 54 mounted on the ring 50. The rollers 52 ride on the upper surface of a sheet metal floor plate 56 which forms a floor to the merchandise containing area of the machine 10, to support the drum 30 for rotation.

An annular plastic sleeve 58 is secured to the lower surface of base disk 46 and is matingly received in annular sleeve 60 secured to the floor plate 56. Both the base disk 46 and floor plate 56 have corresponding circular holes 62 and 64, respectively, which together with the sleeves 58 and 60 allow air to flow from the lower portion of the cabinet into the center column 34. Air handling and refrigeration equipment (not shown) contained in the lower portion of the cabinet is used to force cold air in the center column 34 through the sleeves 58 and 60 where it is then distributed uniformly over the products on the shelves 40 by passing through the plurality of holes 66 and 68 formed in each of the panels 36, as shown by the arrows in FIG. 3. The holes 68 are formed specifically to allow cold air to pass from the inside of the center column 34 outward onto each of the shelves 40 formed by the trays 42. Holes 66, on the other hand, are formed to allow a bottle cap and neck to be passed into the inside of center column 34 as described in detail below.

Also forming part of the merchandise carrying drum 30 are a plurality of radially extending walls 70, which in the preferred embodiment number six. Each of these walls 70 extend for the full height of the drum and are secured at their upper and lower ends to the top disk and base disk 46, respectively, of the drum 30 for rotation therewith. The walls 70 are preferably plastic and transparent Trays 42 extend between adjacent walls 70 to form with the walls a plurality of compartments around each shelf 40.

Figure 5:
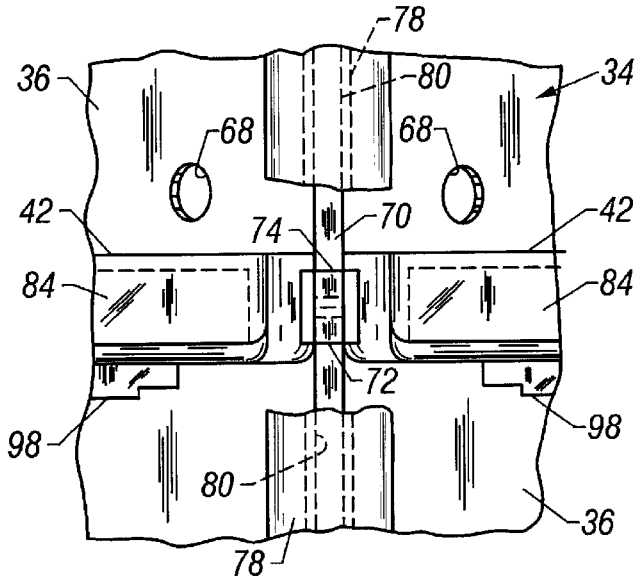
FIG. 5 is an enlarged partial front view of two shelves and an interconnecting wall of the drum of the preferred embodiment.

The trays 42 each have tabs 72 and 74 on opposite outer edges of each as shown in FIG. 5. Tab 72 is formed on the lower edge of the tray while tab 74 is formed on the upper opposite edge of the tray so that two adjacent trays can have their tabs nest with one another when they are positioned in the drum 30. The lower tab 72 of each tray 42 rests on the bottom surface of a rectangular notch 76 cut in the walls 70 at the proper places for locating the trays 42 to form the shelves 40. Once all of the trays are positioned in the notches 76 between adjacent walls 70 a channel-shaped vertical locking strip 78, preferably formed of a metal extrusion, is fixed at the ends of the adjacent walls 70 to prevent the tabs 72 and 74 from being removed from the notches 76 and thus locking the trays 42 in place. Formed as part of the strip 78 is a groove 80 which receives the edge of the wall 70 and helps rigidify it The strip is preferably bolted at its upper and lower ends to the top disk and bottom disk of the drum 30.

Each of the trays 42 is generally dish-shaped with short side walls and can be further subdivided into smaller compartments. In each tray 42 there are provided a series of vertical channels 82 formed in the outer vertical edge wall 84 and facing the center column 34. In the preferred embodiment there are preferably five such channels which allow the tray to be divided in half, in thirds or in quarters. On the inner wall 86 of each tray are formed a series of grooves 88 which are aligned with the channels 82, partitioning walls 90 are formed to be received in the channels 82 and grooves 88 to divide the trays as desired. The outer vertical edge 92 of each partitioning wall 90 is a wide flange which is matingly received in the channels 82. The inner vertical edge 94 of each partitioning wall 90 has a tab 96 extending from the lower portion thereof which is received in the grooves 88.

In order to rigidify the partitions 90 they are designed to engage the bottom of the tray above them. To achieve this in the preferred embodiment the bottom of each tray 42 is provided with a long tab 98 (FIG. 4) in alignment with the channels 82 and grooves 88 in each tray. A connecting piece 100 (FIG. 3) is provided which has a deep groove (not shown) along its lower edge for receiving the upper edge of a partition 90 and has a shallower groove (not shown) in its upper edge for receiving the long tab 98 in the lower surface of a tray. To assemble a partition between a top and bottom tray, the partition is first placed in the bottom tray with its outer edge 92 in a desired channel 82 and its tab 96 in a corresponding grooves 88 so that the lower edge of the partition abuts the upper surface of the bottom tray. The connecting piece is then slid onto the top edge of the partition and simultaneously along the long tab 98 until it is abutting the center column 34. This locks the partition rigidly in place. This assembly procedure is repeated for as many of the partitions as is desired. The partitions 90 are preferably all made of transparent plastic to allow a customer to see more product than is in a single compartment.

Figure 4:
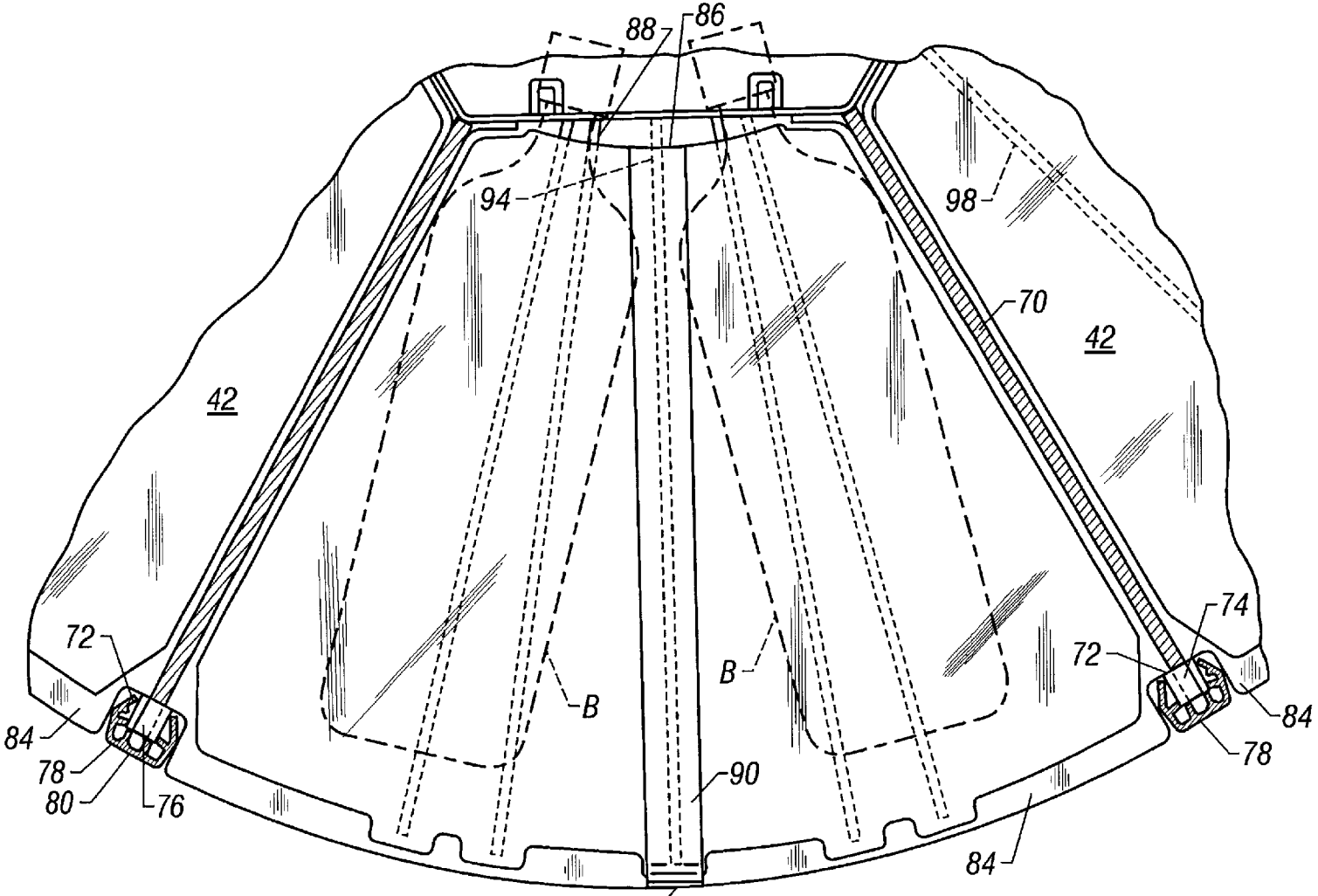
FIG. 4 is an enlarged partial cross sectional view similar to FIG. 2. of a portion of a shelf.
Figure 6:
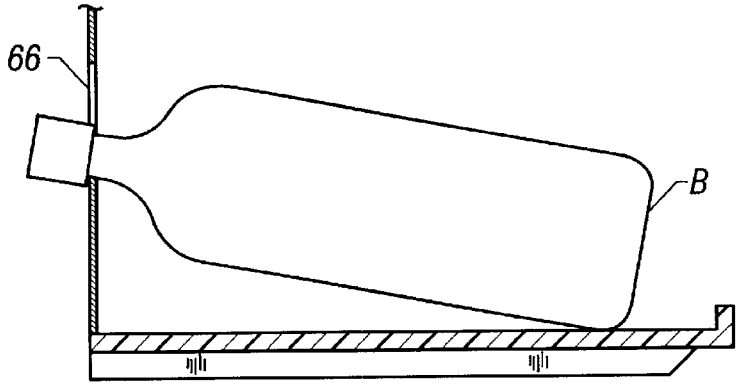
FIG. 6 is an enlarged partial side view of a compartment with a bottle positioned in the compartment with its neck and cap positioned in an opening in the center column and its bottom resting on a shelf.
Figure 7:
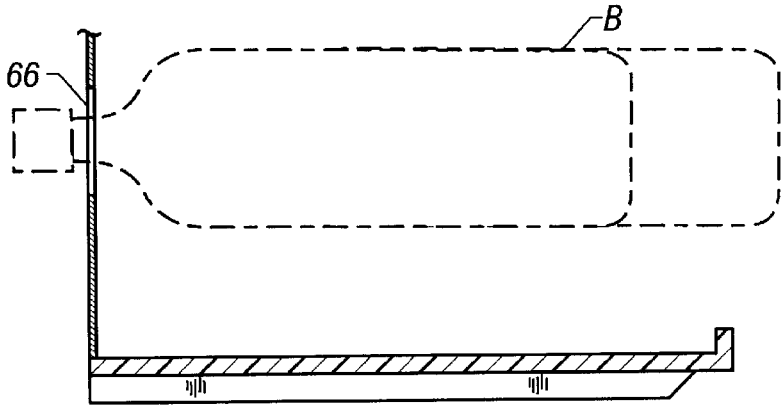
FIG. 7 is a view similar to FIG. 6 showing how the bottle is inserted and removed from the hole in the center column.

Referring again to holes 66, two of these holes are formed above each tray 42 at a height relative to the tray such that bottles B of the 16 to 20 ounce variety can be positioned as shown in FIGS. 6 and 7. Holes 66 are each formed so that the cap of a bottle B can pass through the hole 66 and the bottle B is then tilted so that the edge of its base rests on the tray 42 and the neck of the bottle B rests on the edge of the center column forming hole 66. As shown in FIGS. 2 and 4 a partition 90 can be positioned on a tray 42 so as to divide the tray in half so that a bottle B can be positioned in each of the two compartments thus formed with their respective caps extending through a respective hole 66 thus doubling the bottle storage capacity on a shelf 40, if desired. Otherwise, a single bottle B is positioned with its cap extending through one of the two holes 66 formed in a full sized compartment. Bottles can be positioned in as many or as few of the compartments, either full or half sized, on the shelves 40 as desired. As an example of the relative proportions of the trays 42, holes 66 and the bottle sizes that can be utilized in the present invention, the holes 66 can be 1½ inches in diameter with its center approximately 3 inches above the tray 42 and with the distance from the surface of the center column 30 to the outer edge of the tray 42 being approximately 8½ inches. This arrangement supports 16 and 20 ounce bottles which are typically approximately 9 inches in height and about 3 inches in diameter, as well as 1 liter bottles which are typically 10 inches in height and approximately 3⅛ inches in diameter. Smaller products, such as 8, 10 and 12 ounce bottles, can also be utilized in this configuration.

In addition to providing room for bottles longer than could otherwise be positioned between the center column 34 and the outer edge of a tray 42, the opening 66 allows the bottle to be hooked by the edge of the cap or an adjacent lip on the bottle neck, as shown in FIG. 6. This keeps the bottle from moving outward on the tray 42 as the drum 30 is rotated. Otherwise, the bottle might become wedged between the outer edge of the tray 42 and the inside of the cabinet as the drum 30 is rotated, possibly causing damage to the machine or its contents. When a bottle is aligned with an access door 12 for removal, the customer merely opens the door and lifts the rear of the bottle and then the cap off of the edge of the opening 66 and withdraws the bottle from the opening as shown in FIG. 7.

Alternatively, the opening 66 can be in the form of an embossment or recess formed in the side of column 34 for receiving the bottle cap and neck and not actually forming a hole in the wall of the column. Likewise, if desired it is contemplated that a plastic insert can be placed in the hole 66 of generally hat shaped configuration to receive the bottle cap and neck, with or without an opening into the interior of the column 34.

Referring again to the operation of the machine 10, the drum 30 is rotated by a reversible electric motor 106 (FIG. 3) whose operation is controlled by a microprocessor in a well known manner. The motor 106 has a gear 108 secured to its output shaft which is drivingly engaged with the ring gear 48 secured to the bottom of the drum 30. Rotation of the motor 106 in either direction to allow a customer to review product in various areas of the drum 30 is controlled by two buttons 107 and 109 on the front of the cabinet 16 (FIG. 1). This allows a customer to rotate the drum 30 either left or right by pushing the appropriate button 107 or 109. The microprocessor keeps track of the rotational position of the drum 30 through input from the motor 106 and a microswitch 111. Switch 111 is activated when a home position pin 113, secured to the bottom of ring gear 48, engages the arm of a bi-directional rotating thermal break actuator 115 mounted for rotation in the cabinet floor. The actuator 115 has a camming surface on its lower end which engages the microswitch 111 and activates it when the pin 113 engages the arm of the actuator and moves it as the drum rotates in either direction. The actuator is biased by a spring (not shown) to a home position where it will be engaged by the pin 113 the next time it passes.

In order to accurately stop the turning of the drum 30 so that a selected compartment is located directly in front of the appropriate access door 12, a spring loaded solenoid 110 is used. When the motor 106 is to be activated the solenoid 110 is first activated to remove its plunger 112 from one of a series of corresponding holes 114 formed in the underside of the ring gear 48. There is a hole 114 corresponding to each possible partition 90 and wall 70 location in the drum 30 so that each compartment can be exactly registered with an appropriate access door 12. Thus, for the preferred embodiment there will be thirty six holes 114.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A multiple product merchandising machine, the machine dispensing a bottle of a product, the machine comprising:

a cabinet;

a cylindrical merchandise carrying drum mounted within the cabinet for rotation about its central longitudinal axis disposed vertically within the cabinet and having a plurality of annular product supporting shelves at spaced intervals along the drum, concentric with the axis of the drum, a plurality of vertical walls extending between adjacent shelves and together with the shelves defining a plurality of individual product compartments, a central column extending the height of the drum and having wall portions adjacent each product compartment with at least one hole defined in at least some of the wall portions, the at least one hole so positioned and arranged that a necked-down portion of the bottle supporting a cap can be inserted into the at least one hole with the remainder of the bottle being disposed within the confines of an associated product compartment; and a plurality of access doors in the cabinet for allowing access to the shelves for removal of merchandise therefrom; and a vend control system associated with the access doors for allowing the doors to be opened upon a customer establishing a proper amount of credit in the vend control system.

2. A multiple-product merchandising machine as defined in claim 1 wherein the at least one hole is vertically positioned within an associated compartment such that the necked-down portion of the bottle inserted in the hole engages a lower portion of the hole and rests on the wall portion in a manner such that the bottle is disposed at an angle sloped downwardly toward an outer edge of the compartment.

3. A multiple-product merchandising machine as defined in claim 1 wherein the at least one hole is so positioned and arranged that the cap of the bottle disposed in the at least one hole engages a rear side of the wall portion so as to prevent outward movement of the bottle until it is lifted by a customer to be removed from the compartment.

4. In a multiple product merchandising machine, the machine dispensing a bottle of a product, the machine having a cabinet; a cylindrical merchandise carrying drum mounted within the cabinet for rotation about its central longitudinal axis disposed vertically within the cabinet and having a plurality of annular product supporting shelves at spaced intervals along the drum, concentric with the axis of the drum, a plurality of vertical walls extending between adjacent shelves and together with the shelves defining a plurality of individual product compartments, a central column extending the height of the drum and having wall portions adjacent each product compartment; a plurality of access doors in the cabinet for allowing access to the shelves for removal of merchandise therefrom; and a vend control system associated with the access doors for allowing the doors to be opened upon a customer establishing a proper amount of credit in the vend control system, wherein the improvement comprises:

at least some of the wall portions defining at least one hole, the at least one hole so positioned and arranged that a necked-down portion of the bottle supporting a cap can be inserted into the at least one hole with the remainder of the bottle being disposed within the confines of an associated product compartment.

5. In a multiple product merchandising machine as defined in claim 4 wherein the at least one hole is vertically positioned within an associated compartment such that the necked-down portion of the bottle inserted in the hole engages a lower portion of the hole and rests on the wall portion in a manner such that the bottle is disposed at an angle sloped downwardly toward an outer edge of the compartment.

6. In a multiple product merchandising machine as defined in claim 4 wherein the at least one hole is so positioned and arranged that the cap of the bottle disposed in the at least one hole engages a rear side of the wall portion so as to prevent outward movement of the bottle until it is lifted by a customer to be removed from the compartment.

* * * * *